US009033038B2

(12) United States Patent
Hetz et al.

(10) Patent No.: US 9,033,038 B2
(45) Date of Patent: May 19, 2015

(54) SPEED CONTROL DEVICES AND METHODS FOR DROP DOWN TOOLS

(75) Inventors: Avigdor Hetz, Houston, TX (US); Doron Hetz, Houston, TX (US); John G. Evans, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 270 days.

(21) Appl. No.: 13/593,089

(22) Filed: Aug. 23, 2012

(65) Prior Publication Data

US 2014/0054030 A1 Feb. 27, 2014

(51) Int. Cl.
*E21B 47/09* (2012.01)
*E21B 47/16* (2006.01)

(52) U.S. Cl.
CPC ..... *E21B 47/09* (2013.01); *E21B 47/16* (2013.01)

(58) Field of Classification Search
CPC ..... E21B 47/09
USPC ..... 166/250.01, 64, 254.2; 73/152.56
See application file for complete search history.

(56) References Cited

U.S. PATENT DOCUMENTS 3,050,130 A * 8/1962 Culver et al. ..... 166/153
3,109,693 A 11/1963 Clements et al.
3,356,146 A 12/1967 Anderson
4,109,521 A * 8/1978 Youmans ..... 73/152.17
4,597,440 A 7/1986 Pottier
4,676,310 A * 6/1987 Scherbatskoy et al. .... 340/853.4
4,715,446 A 12/1987 Wittrisch
4,783,995 A 11/1988 Michel et al.
5,022,484 A 6/1991 Panetta et al.
5,183,113 A 2/1993 Leaney et al.
5,205,167 A 4/1993 Gartner et al.
5,208,936 A * 5/1993 Campbell ..... 15/104.061
5,605,192 A * 2/1997 Bjørnstad ..... 166/254.2
7,661,475 B2 2/2010 Sheiretov et al.
8,650,694 B2 * 2/2014 Pruett et al. ..... 15/104.061
2002/0117300 A1 * 8/2002 Spencer et al. ..... 166/254.2
2012/0298355 A1 * 11/2012 Digby ..... 166/254.2

FOREIGN PATENT DOCUMENTS

CN 201318163 Y 9/2009
CN 201802385 U 4/2011
RU 2370638 C1 10/2009
WO 2011037591 A1 3/2011

* cited by examiner

*Primary Examiner* — Kenneth L Thompson
(74) *Attorney, Agent, or Firm* — Mossman, Kumar & Tyler, PC

(57) ABSTRACT

An apparatus for evaluating an earth formation intersected by a wellbore may include a logging tool conveyed into the wellbore through a drilling tubular, a speed control device associated with the logging tool, and a sensor operatively associated with the logging tool. In use, the speed control device varies an annular flow space between the speed control device and a surface adjacent to control speed. The flow space may be varied using a annular member that flexes between a nominal diameter and a second larger diameter.

18 Claims, 3 Drawing Sheets

SPEED CONTROL DEVICES AND METHODS FOR DROP DOWN TOOLS

CROSS-REFERENCE TO RELATED APPLICATIONS

None.

BACKGROUND OF THE DISCLOSURE

1. Field of the Disclosure

This disclosure relates generally to fluid conveyed tools deployed in a well.

2. Background of the Art

Oil or gas wells are often logged to determine one or more geological, petrophysical, geophysical, and well production properties ("parameters of interest") using electronic measuring instruments conveyed along a wellbore. Tools adapted to perform such surveys are sometimes referred to as logging tools. These tools may use electrical, acoustical, nuclear and/or magnetic energy to investigate a formation traversed by the wellbore. In some aspects, the present disclosure relates to methods and devices for conveying logging tools into a wellbore. More generally, the present disclosure relates to methods and device for controlling the speed at which well tools are transported along a wellbore.

SUMMARY OF THE DISCLOSURE

In aspects, the present disclosure provides an apparatus for use in a wellbore. The apparatus may include a logging tool configured to be conveyed along the wellbore through a wellbore tubular, a speed control device associated with the logging tool, and a sensor associated with the tool and configured to estimate at least one selected subsurface parameter while the tool is in the wellbore tubular. The speed control device may include an annular ring member that varies an annular flow space between the speed control device and the wellbore tubular. The annular ring member flexes between a nominal diameter and a second larger diameter.

In further aspects, the present disclosure provides a method of using a tool in a wellbore. The method may include estimating at least one subsurface parameter using a sensor associated with the tool after conveying the tool to a selected subsurface location in the wellbore using a speed control device associated with the tool. The speed control device may control a speed of the tool using an annular ring member configured to vary an annular flow space between the speed control device and a wellbore tubular. The annular ring member may flex between a nominal diameter and a second larger diameter.

In still further aspects, the present disclosure provides an apparatus for use in a wellbore that includes a tool configured to be conveyed into the wellbore and a speed control device associated with the tool. The speed control device may include an annular member configured to vary an annular flow space between the speed control device and a surface adjacent to an outer surface of the annular member. The annular member may flex between a nominal diameter and a second larger diameter.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

Aspects of the present disclosure provide a speed control device that controls the speed at which a tool travels along a wellbore tubular. In some arrangements, the speed control device is attached to the tool and is responsive to the speed of the tool relative to a surrounding fluid. Hereafter, terms such as "speed of the tool" or "tool speed" should be understood as relative to the fluid through which the tool travels. In one arrangement, the speed control device expands diametrically as the speed of the tool increases. This diametrical expansion increases flow resistance, which acts as a brake that slows the tool. It should be appreciated that the speed control device may be configured to control speed in a closed loop fashion by being continually responsive to the speed of the tool and automatically applying a predetermined amount of flow resistance to maintain the tool at a desired speed, below a desired speed, and/or within a range of speeds. Further, the speed control device may act as a shock absorber that absorbs at least some of the energy associated with the landing of the tool at a specified location in the well.

Speed control devices in accordance with the present disclosure may be used to safely convey any tool along a wellbore. For example, aspects of the present disclosure may be used in conjunction with tools deployed during drilling, logging a drilled well, completion, or production. Moreover, the speed control device may be used to control speed of a tool traveling through any wellbore tubular (e.g., jointed drill pipe, coiled tubing, casing, liner, production tubing, etc.). Merely for brevity, the present discussion will be directed to embodiments of speed control devices used to safely position a logging tool at a target location inside an umbilical associated with a wellbore drilling system.

Figure 1:
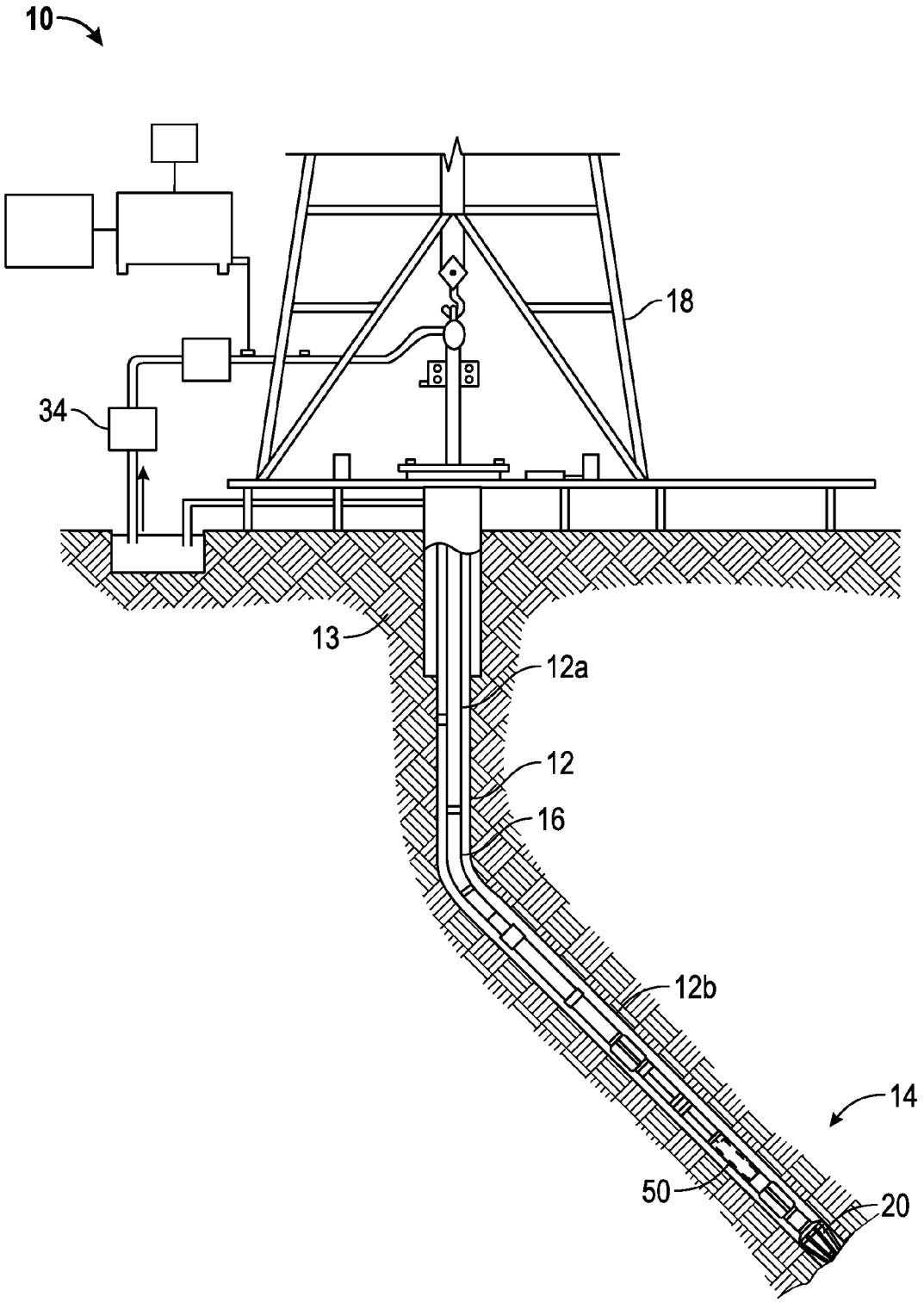
FIG. 1 illustrates a drilling system made in accordance with one embodiment of the present disclosure.

Referring now to FIG. 1, there is schematically illustrated one such drilling system 10 for forming a wellbore 12 in an earthen formation 13. While a land-based rig is shown, these concepts and the methods are equally applicable to offshore drilling systems. The wellbore 12 may include one or more vertical sections 12*a* and one or more inclined sections 12*b*. An inclined wellbore is a bore that has an angle relative to a horizontal plane. The wellbore 12 may also include horizontal sections or branch wellbores (not shown). The drilling system 10 may use a bottomhole assembly (BHA) 14 conveyed by an umbilical, such as a drill string 16 suspended from a rig 18. The drill string 16 may include a drill bit 20 at a distal end. The drill string 16 may include any known wellbore tubular adapted for use in a wellbore, e.g., jointed drill pipe, coiled tubing, casing, liner, etc. In certain situations, a logging tool 50, shown in hidden lines, may be used to acquire information relating to the wellbore 12 and/or formation 13 while the drill string 16 is "tripped out" of the wellbore 12. As used herein, the term "trip" or "tripping" refers to movement of the drill string 16 along the wellbore 12; e.g., "tripping out" refers to extraction of the drill string 16 from a wellbore 12.

Figure 2:
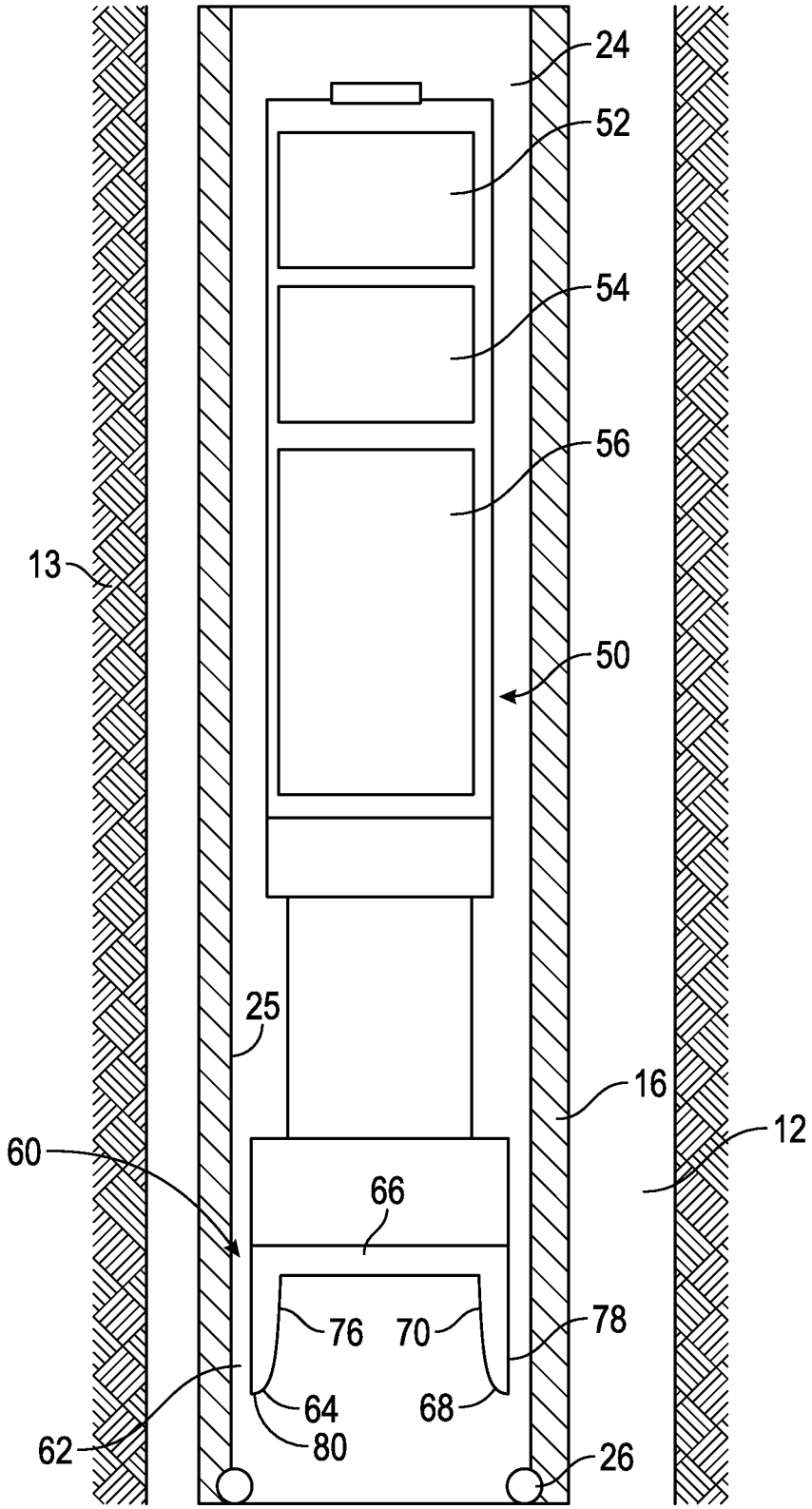
FIG. 2 schematically illustrates a logging tool that includes a speed control device made in accordance with one embodiment of the present disclosure.

FIG. 2 illustrates the exemplary components of a logging tool 50 that may be used to log a well while the drill string 16 is tripped out of the wellbore 12. The logging tool 50 is shown positioned inside a portion of the drill string 16 and at the target location. In the embodiment shown, the logging tool 50 includes a power section 52, a controller 54 for operating the logging tool 50, and a sensor section 56 for logging the well. These components may be inside one unitary structure, within separate interconnected modules, or otherwise associated with the logging tool 50. The power section 52 may include resident electrical power sources such as batteries to energize the components of the logging tool 50. The controller 54 may include information processing devices such as processors programmed with instructions and memory modules for storing information acquired during the logging activity.

The sensor section 56 includes instruments for estimating parameters of interest relating to one or more selected subsurface features such as the formation 13 and/or the wellbore 12. Because the logging tool 50 may reside inside of the drill string 16, the sensor section 56 may include instruments that can measure wellbore or formation properties through a wall of a wellbore tubular such as the drill string 16 or casing (not shown), including but limited to pulsed neutron logging tools, neutron porosity tools using chemical neutron sources, cased hole resistivity tools, or acoustic tools. However, it should be appreciated that the teachings of the present disclosure are not limited to any specific types of instruments. Thus, the sensor section 56 may include resistivity tools, nuclear magnetic resonance (NMR) tools, and other well logging tools that provide information relating to a geological parameter, a geophysical parameter, a petrophysical parameter, and/or a lithological parameter. The sensor section 56 may include sensors that output signals representative of a sensed parameter and sources (e.g., pulsed neutrons) that emit an energy wave into the formation 13. Other illustrative instruments used in the sensor section 56 may estimate dielectric constant, the presence or absence of hydrocarbons, acoustic porosity, bed boundary, formation density, nuclear porosity and certain rock characteristics, permeability, capillary pressure, and relative permeability. The tools may also estimate wellbore parameters such as inclination, azimuth, wellbore diameter, rugosity, etc. These parameters collectively will be referred to as "subsurface" parameters.

A logging operation using the logging tool 50 first requires that the logging tool 50 be conveyed into the wellbore 12 and positioned at a reference location. The reference location may be a travel restrictor 26 that projects radially inwardly into the drill string bore 24 and presents one or more surfaces that block passage of all or a portion of the logging tool 50. For example, the travel restrictor 26 may be a baffle plate that is interconnected between two jointed tubulars. It should be appreciated that the landing of the logging tool 50 at the travel restrictor 26 may subject the logging tool 50 to a shock event that may damage the above-described components on-board the logging tool 50. To protect the logging tool 50 from such damage, the logging tool 50 includes a speed control device 60 that maintains the logging tool 50 at or below a selected speed during descent, e.g., at the time of impact with the travel restrictor 26.

Figure 3:
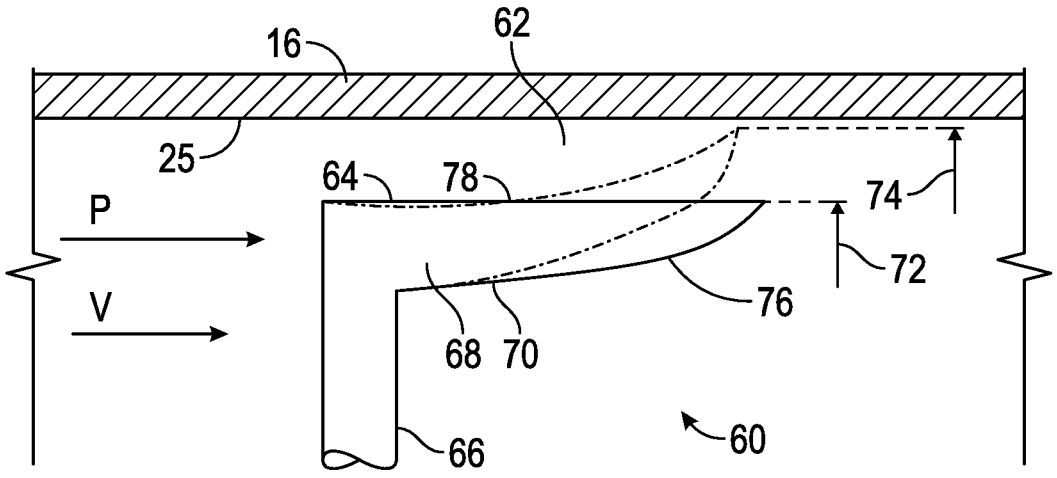
FIG. 3 sectionally illustrates a speed control device made in accordance with one embodiment of the present disclosure.

In one embodiment, the speed control device 60 may be configured to vary the size of an annular flow space 62 as a function of the speed of the logging tool 50. The speed control device 60 may include an annular ring member that varies the annular flow space 62 between the speed control device 60 and an inner wall of the drilling tubular 16. In one embodiment, the annular ring member may be formed as a cup 64 that has a base 66 and a lip 68. The lip 68 may be a wall of a tubular-like body that includes an open cavity 70 that faces or projects downhole and along the long axis of the logging tool 50. Referring now to FIG. 3, in one arrangement, at least a portion of the lip 68 may be formed of a flexible material that allows the lip 68 to elastically flex between a first diameter 72, or a nominal diameter, and a second larger diameter 74. That is, the lip 68 can flex or expand to the larger diameter 74 and also retract or relax back to approximately the first diameter 72. In other embodiments, a certain amount of plastic deformation may be used to control how much the lip 68 can retract from the second diameter 74. As used herein, the term "nominal diameter" refers to the diameter of the lip 68 when not subjected to the forces associated with flow resistance. Further, while the speed control device 60 is described as having several components, it should be understood that that the speed control device 60 may be formed as a unitary body or as an assembly of two or more components.

In one embodiment, the lip 68 remains at the nominal diameter for speeds below a predetermined threshold speed value. The rigidity (or flexibility) of the lip 68 is selected to allow the lip 68 to flex radially outward when the threshold speed value is exceeded. The diametrical expansion of the cup 64 reduces an annular cross-section flow area available for the fluid in an annulus 62 to flow past the logging tool 50. In this embodiment, the annulus 62 is a flow space formed by the speed control device 60 and a wall 25 of the drilling tubular 16. However, the annulus 62 may be formed by any wall defining a passage through which the logging tool 50 travels. This reduced cross-sectional flow area increases flow resistance and reduces the speed of the logging tool 50.

In some embodiments, the lip 68 may be a circumferentially continuous ring such that fluid must flow around the lip 68. In other embodiments, the lip 68 may be segmented such that some fluid may flow through spaces or openings (no shown) between segments of the lip 68. Further, the shape and dimensions of the inner surface 76 and/or the outer surface 78 of the lip 68 may be selected to provide the lip 68 with a specified amount of rigidity. As shown, the inner surface 76 is arcuate in order to provide a gradual reduction in the thickness of the lip 68 with the thinnest portions being at a rim 80 of the lip 68. It should be understood that other geometric shapes may also be used; e.g., a wedge have a planar surface or a stepped surface. Other techniques, such as circular grooves may be used to simulate a hinge type of connection to thereby allow diametrical expansion of the lip 68. The amount of flexure for a particular design may depend on the weight of the logging tool 50, the diameter of the inner bore 24, the properties of the fluid in the inner bore 24, and other factors relating to wellbore and tool geometry and operating parameters. Suitable materials for the lip 68 include, but not limited to, polymers such as rubbers and other materials having a Modulus of Elasticity (modulus) of 0.01 to 3 $10^9$ N/$m^2$.

The speed control device 60 may also be configured to absorb at least some of the energy associated with the impact of the logging tool 50 on the travel restrictor 26. That is, one or more portions of the cup 68, such as the base 66 or the lip 68, may be formed of a material having a modulus selected to elastically and/or plastically deform upon impact. The speed control device 60 may also include other devices, such as coil springs (not shown), that can absorb some of the impact energy that would otherwise be transferred to the components of the logging tool 50.

Referring now to FIGS. 1-3, in one illustrative operation, the logging tool 50 is inserted into the drill string bore 24 after drilling has stopped. For the well geometry of the wellbore in FIG. 1, the logging tool 50 may be dropped into an inner bore 24 of the drill string 16 and allowed to free fall along the vertical section 12*a*. Thereafter, the logging tool 50 may free fall along the highly inclined section 12*b*. During this descent, the logging tool 50 may free fall under the effect of primarily gravity. That is, fluid is not being pumped into the bore 24. During this travel, the drilling fluid residing in the drill string 16 resists the movement of the logging tool 50. Referring now to FIG. 3, below a predetermined speed of the logging tool 50, the differential in the fluid pressure inside the cavity 70 and the fluid pressure at the outer surface 78 is not sufficient to overcome the rigidity of the lip 68. Under those conditions, the lip 68 is in the nominal diameter and the speed control device 60 does not moderate tool speed by radially flexing. If the predetermined speed is exceeded, the pressure differential between the cavity 70 and the outer surface 78 is sufficient to flex the lip 68 radially outward. The amount of flexure may vary directly with the amount of the pressure differential in this condition. As the lip 68 flexes radially outward, the size of the annular flow passage 68 is reduced. The reduced flow passage increases flow resistance and thereby reduces the logging tool speed. As speed is reduced, the pressure differential decreases, which allows the lip 68 to relax toward the nominal diameter. By appropriately selecting an elasticity/rigidity for the lip 68, the speed control device 60 may maintain the logging tool 50 at or below a desired speed or within a desired speed range. By controlling speed in this manner, the risk that the impact of the logging tool 50 with the travel restrictor 26 may cause damage to the logging tool 50 is reduced. Also, some or all of the mechanical shock generated by the impact may be absorbed by one or more components of the speed control device 60.

If the logging tool 50 is to be positioned in the inclined or vertical leg of the well, the logging tool 50 travels under the force of gravity until the travel restrictor 26 is reached. If the logging tool 50 is to be positioned in a near horizontal leg of the well, the logging tool 50 travels under the force of gravity no longer propels the logging tool 50. Thereafter, fluid may be pumped down the bore of the drill string 16 to push or flow the logging tool 50 to the travel restrictor 26. In either case, the speed control device 60 may absorb at least some of the energy associated with the impact of the logging tool 50 on the travel restrictor 26 due to elastic and/or plastic deformation of the cup 68 or other component of the speed control device 60.

Figure 4:
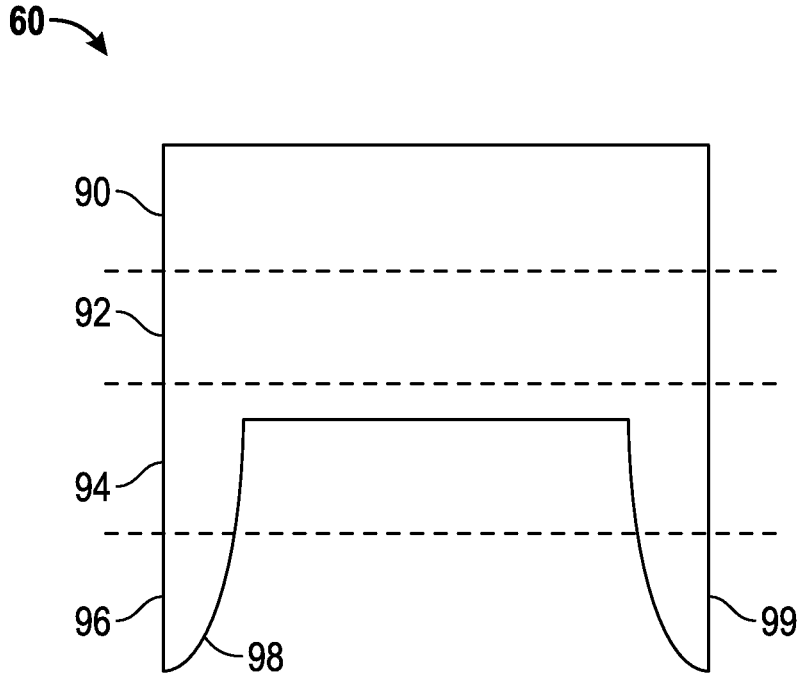
FIG. 4 sectionally illustrates another embodiment of a speed control device made in accordance with the present disclosure.

It should be understood that the speed control device 60 is susceptible to various modifications and variations. For example, referring now to FIGS. 2 and 4, there is shown an embodiment of a speed control device 60 that includes sections having different amounts of rigidity or Modulus of Elasticity. In one arrangement, the speed control device 60 has a relatively rigid region 90 and one or more relatively elastic regions 92, 94, 96. The rigid region 90 may have a modulus of elasticity selected to prevent deformation while traveling through a wellbore and plastically deform upon impact with the travel restrictor 26. The elastic regions 92, 94, 96 may have their respective modulus of elasticities selected to control descent speed as the elastic regions 92, 94, 96 expand and relax in response to the speed of the logging tool 50. The rigid region 80 does not flex or deform during this time. Upon impact with the travel restrictor 26, the plastic region 90 is compressed between the travel restrictor 26 and the logging tool 50. This compressive force reduces the axial length of the plastic region 90 and diametrically expands the plastic region 90. When fluid is pumped into the drilling tubular 16, the expanded plastic region 90 substantially restricts flow in the surrounding annulus 68. By substantially, it is meant that fluid flow is restricted to a degree that a pressure spike in the fluid column in the bore 24 can be detected at the surface and that the pressure spike can be uniquely attributed to the landing of the tool 50 at the travel restrictor 26. Thus, the speed control device 60 can also act as a landing indicator by enabling a detectable pressure spike in the wellbore tubular.

It should be appreciated that the elastic regions 92, 94, 96 may also be configured to plastically deform to generate a pressure spike. It should also be appreciated that the number and position of rigid and elastic regions can be varied as needed for a particular application and that the present disclosure is not limited to the particular arrangement shown in FIG. 4 or any of the other Figures. Also, the plastic deformation need not be permanent. For example, the section or sections that expand to generate the pressure spike may be retracted or returned to a smaller diametrical condition.

In other embodiments, rather than forming the lip 68 with a material having a modulus that allows flexure or deformation, the lip may use springs, torsion rods, and other similar biasing elements. Furthermore, while embodiments of the present disclosure have been described as travelling through a drilling tubular, variants of the present disclosure may also be used to control speed of tools conveyed through a riser used for offshore drilling platforms, casing, liners, or even in an open hole well. It should be appreciated the annular member, or cup 68, can readily be modified to control the size of the annular flow space of the device and an adjacent wall defining a passage way along any of these features.

In the arrangements described above, the logging tool 50 is constructed to function as a "drop tool" (e.g., a 'go devil'). A "drop tool" is a device that is not tethered to a non-rigid carrier such as a wireline or slickline. However, the logging tool 50 may be constructed as a hybrid "drop tool" in that a non-rigid carrier may be used to guide or control the logging tool 50 until the target depth is reached. The logging tool 50 may include a quick disconnect device that allows the non-rigid carrier to be disconnected and retrieved to the surface before the logging tool 50 is activated. A non-rigid carrier may be a wireline (power and data), an e-line (power only), or a slickline (no power or data).

While the present teachings have been discussed in the context of a logging while tripping a tool out of the wellbore, it should be understood that embodiments of the present disclosure may be advantageously applied to other wellbore tools. Moreover, while the present disclosure discusses a hydrocarbon producing well, the present teachings may also be used with other types of wells (e.g., geothermal wells, water wells, etc.) While the foregoing disclosure is directed to certain embodiments of the disclosure, various modifications will be apparent to those skilled in the art. It is intended that all variations within the scope of the appended claims be embraced by the foregoing disclosure.

We claim:

1. An apparatus for use in a wellbore, comprising:

a logging tool configured to be conveyed along the wellbore through a wellbore tubular;

a speed control device associated with the logging tool, the speed control device including an annular ring member configured to vary an annular flow space between the speed control device and the wellbore tubular, the annular ring member being configured to flex between a nominal diameter and a second larger diameter wherein the annular ring member elastically flexes from the nominal diameter to the second diameter as a speed of the tool increases; and a sensor associated with the tool and configured to estimate at least one selected subsurface parameter while the tool is in the wellbore tubular.

2. The apparatus of claim 1, wherein the speed control device includes a cup having a lip and wherein the annular ring member is formed on at least a portion of the lip.

3. The apparatus of claim 2, wherein the lip defines a cavity projecting downhole along a tool axis of the logging tool.

4. The apparatus of claim 3, further comprising an inwardly projecting member fixed along the wellbore tubular and wherein the lip is configured to have a diameter selected to land on the inwardly projecting member.

5. The apparatus of claim 4, wherein the speed control device is at least partially formed of a material configured to absorb energy associated with the landing of the lip on the inwardly projecting member.

6. The apparatus of claim 2, wherein the cup is formed at least partially of a material having a modulus no greater than a modulus of an elastomer.

7. The apparatus of claim 2, wherein at least a portion of the cup expands upon impact with a travel restrictor positioned along the wellbore tubular, wherein the expanded portion of the cup substantially restricts fluid flow along a surrounding annular flow space.

8. The apparatus of claim 1, wherein the sensor is configured to estimate at least one of: (i) geological parameter, (ii) a geophysical parameter, (iii) a petrophysical parameter, and (iv) a lithological parameter.

9. A method of using a logging tool in a wellbore, comprising:

estimating at least one subsurface parameter using a sensor associated with the tool after conveying the tool to a selected subsurface location in the wellbore using a speed control device associated with the tool, the speed control device controlling a speed of the tool using an annular ring member configured to vary an annular flow space between the speed control device and a wellbore tubular, the annular ring member being configured to flex between a nominal diameter and a second larger diameter, wherein the annular ring member elastically flexes from the nominal diameter to the second diameter as a speed of the tool increases.

10. The method of claim 9, wherein the speed control device includes a cup having a lip and further comprising forming the annular ring member on at least a portion of the lip having a cavity projecting downhole along a tool axis of the logging tool.

11. The method of claim 10, further comprising landing the tool on an inwardly projecting member fixed along the wellbore tubular.

12. The method of claim 11, wherein the speed control device is at least partially formed of a material configured to absorb energy associated with the landing of the lip on the inwardly projecting member.

13. The method of claim 9, further comprising:

generating a pressure spike in the wellbore tubular using the speed control device;

detecting the pressure spike at the surface; and retrieving the tool after detecting the pressure spike.

14. The method of claim 9, wherein the sensor is configured to estimate at least one of: (i) geological parameter, (ii) a geophysical parameter, (iii) a petrophysical parameter, and (iv) a lithological parameter.

15. An apparatus for use in a wellbore, the apparatus comprising:

a logging tool configured to be conveyed into the wellbore; and a speed control device associated with the tool, the speed control device including an annular member configured to vary an annular flow space between the speed control device and a surface adjacent to an outer surface of the annular member, the annular member being configured to flex between a nominal diameter and a second larger diameter, wherein the annular ring member elastically flexes from the nominal diameter to the second diameter as a speed of the tool increases.

16. The apparatus of claim 15, wherein the speed control device includes a cup having a lip, wherein the annular ring member is formed on at least a portion of the lip having a cavity projecting downhole along a tool axis of the logging tool.

17. The apparatus of claim 16, further comprising an inwardly projecting member fixed along the wellbore tubular and wherein the lip is configured to have a diameter selected to land on the inwardly projecting member.

18. The apparatus of claim 16, wherein the speed control device is at least partially formed of a material configured to absorb energy associated with the landing of the lip on the inwardly projecting member.

* * * * *